US005286139A

United States Patent [19]

Hair

[11] Patent Number: 5,286,139

[45] Date of Patent: Feb. 15, 1994

[54] INTERLOCKING PAVING STONE FOR CLOSED AND OPEN DRAINAGE PATTERNS

[76] Inventor: Roberta A. Hair, 7554 Wooster Rd., Cincinnati, Ohio 45227

[21] Appl. No.: 829,391

[22] Filed: Feb. 3, 1992

[51] Int. Cl.[5] ..... E01C 5/00

[52] U.S. Cl. ..... 404/41; 404/38; 404/42; 52/311.2

[58] Field of Search ..... 52/311, 604, 608, 609; 404/34, 37, 38, 39, 41, 42; D25/114, 116, 118

[56] References Cited

U.S. PATENT DOCUMENTS

| | | | |
|---|---|---|---|
| 572,762 | 12/1896 | Landers . | |
| 962,150 | 6/1910 | Jennison . | |
| 1,379,440 | 5/1921 | Brainerd . | |
| 2,210,150 | 8/1940 | Notari . | |
| 3,759,043 | 9/1973 | Tokunaga . | |
| 4,052,131 | 10/1977 | Lowrigkeit . | |
| 4,128,357 | 12/1978 | Barth et al. | 404/41 |
| 4,544,305 | 10/1985 | Hair | 404/34 X |
| 4,773,790 | 9/1988 | Hagenah | 404/38 X |
| 4,781,492 | 11/1988 | Shindo . | |
| 4,834,575 | 5/1989 | Barth et al. . | |
| 4,973,192 | 11/1990 | Hair . | |
| 4,997,308 | 3/1991 | Welling, Jr. . | |
| 5,054,957 | 10/1991 | Johnson, II . | |
| 5,108,219 | 4/1992 | Hair | 404/42 X |

FOREIGN PATENT DOCUMENTS

| | | | |
|---|---|---|---|
| 14742 | 8/1881 | Fed. Rep. of Germany | 404/34 |
| 197711 | 11/1977 | Switzerland . | |
| 552303 | 3/1943 | United Kingdom . | |

OTHER PUBLICATIONS

Text: Tilings and Patterns, Branko Grunbaum and G. C. Sheppard, W. H. Freeman and Company, New York (1987), p. 152.

Uni-Group U.S.A. Brochure, "Uni Eco-Stone", 1991.

*Primary Examiner*—Carl D. Friedman
*Assistant Examiner*—Lan M. Mai
*Attorney, Agent, or Firm*—Donald F. Frei; Joseph R. Jordan

[57] ABSTRACT

A paving stone is provided that can be laid in a plurality of open patterns, each presenting a different amount of drainage area, while retaining an interlocking relationship between adjacent stones of the pattern. In the preferred embodiment, the stone can also be laid in a closed pattern, with no drainage areas provided other than the drainage at the boundaries of the stones. Each side surface of the stone has an odd number of faces, arranged in a stair-step shape. Preferably, each of the side surfaces is symmetrical about the center face, and all sides, or at least opposite sides, are identical.

20 Claims, 8 Drawing Sheets

INTERLOCKING PAVING STONE FOR CLOSED AND OPEN DRAINAGE PATTERNS

The present invention relates to paving stone slab elements for covering horizontal areas such as the ground and, more particularly, to paving stones of the interlocking type.

BACKGROUND OF THE INVENTION

Paving stones of the type to which the present invention relates are manufactured slab elements usually molded of ceramic material, most commonly concrete, into predetermined shapes which, when arranged in a pattern, form a covering for the ground or other surface area which is generally intended to bear pedestrian or vehicular traffic.

Bricks, cut stones and slab elements of various types have been used in the past to cover roads and walkways to form a pavement or ground cover arrangement. In forming the ground cover pattern, the elements are often laid adjacent each other in an array to fully cover the area being paved. The most common shape of element used historically is the rectangular brick like shape which can easily be arranged to fully cover the ground without resort to combinations of stones of different sizes or shapes to do so. Such elements are laid with or without grout or mortar joints which rigidly join one element with another.

A type of ground cover finding increasing use is that formed of the paving stones laid without mortar or grout, usually with joints filled with particulate material such as sand. The advantages which such ground covers present are an ability to tolerate movement and deformation without exhibiting the cracking and breaking which may result with ground covers in which rigid grout or mortar joints are employed.

One disadvantage of most of the paving stones of the prior art, when laid without mortar or grout filling the joints, is that the drainage area between adjacent stones is narrow, typically ⅜" or less, the width of a typical mortar joint. This small spacing is necessary to that the adjacent faces of adjacent stones provide structural support to each other, to hold the stones in place and level. For certain applications, such spacing is inadequate to provide the necessary drainage that the site requires.

A further disadvantage of the stones of the prior art is that the spacing between the stones, and thus the relative portion of the surface area that will accommodate drainage, is fixed for stones of a given shape. Frequently, different sites have different drainage requirements, calling for different portions of the paved surface area to be open for drainage.

Another disadvantage found with some paving stones of the prior art, as for example the simple rectangular elements such as bricks and rectangular stones, is that, when used with sand or other loose fill joint material, surface water flowing on the pavement area formed of such a ground cover has a tendency to wash the joint material from between the elements. A further disadvantage of many such elements is that they have a tendency to tilt or yield under locally heavy loads.

One solution to both the problem of the washing of joint material from between the elements and to the problem of movement under load has been the introduction of mortarless or groutless paving stones of the interlocking type. Such interlocking paving stones are for example those disclosed in the Hair U.S. Pat. Nos. 4,544,305 and 4,973,192 and of Barth U.S. Pat. Nos. 4,128,357 and 4,834,575.

An objective in the design of interlocking paving stones, as seen in the Hair and Barth patents, is the creation of shapes which will interlock in such a way as to fully cover the area being paved with a minimum of different stone shapes. It is highly desirable that stones of a single size and shape be capable of forming an interlocking pattern which fully covers the ground without the need for filler stones of different shapes. Such a characteristic reduces the number of costly molds and the need for distributors and installers to maintain inventories of different stones.

It has also been an objective, difficult in many cases to achieve, to shape the stones in a way that they will not only interlock satisfactorily and form a pattern which fully covers the area being paved, but which will do so with shapes which present boundaries which contribute to a particular aesthetic pattern. By the very nature of the stones, the boundaries which define their shapes make the primary contribution to the overall appearance of the patterns. Unfortunately, not all aesthetically desirable shapes are easily made to interlock effectively. The desire to provide certain shapes in paving stones makes it difficult to design stones which interlock effectively. Thus, the desire to form patterns which yield certain aesthetic effects imposes a constraint on the stone characteristics which preclude the utilitarian properties for which the interlocking stones are desired.

In addition, many paving stones of the prior art have, when attempting to achieve the aesthetic and interlocking pattern forming objectives, failed to produce a stone that is capable of bearing heavy loads and resisting breakage.

Accordingly, there has existed a need for an interlocking paving stone with sides angled and shaped to fully cover the ground with stones of a single size and shape, which are sufficiently strong to gear heavy loads, which can be laid to provide adequate drainage for the requirements of the site, and which can be laid so as to provide a variety of drainage area ratios with a stone of a single shape.

SUMMARY OF THE INVENTION

It is a primary objective of the present invention to provide a paving stone having a shape defined by faces and angles that make up its side surfaces, and which can be laid to form a ground cover that presents adequate open areas for drainage. It is a more particular objective of the present invention to provide a paving stone of a single shape and size, which can be assembled into a plurality of interlocking ground cover patterns to provide a plurality of different ratios of drainage area to covered area. It is an additional objective of the present invention to provide such a paving stone that is structurally strong.

According to the principles of the present invention, there is provided a paving stone having a plurality of multifaced step shaped side surfaces formed of a plurality of faces connected at alternate interior and exterior angles. The stones can be interlocked with some faces of adjacent stones close to each other, and with a predetermined amount of drainage area formed between them.

Further in accordance with principles of the present invention, there is provided a paving stone which, if made in a single size and shape, can be laid with different combinations or pairs of faces of adjacent stones adjacent each other to form a plurality of different patterns, each of which presents a paved surface with a different ratio of drainage area to the ground surface covered.

According to the preferred embodiment of the present invention, there is provided a paving stone with four identical multi-faced sides or side surfaces, each having an odd number of faces, for example, five. Each of the faces is joined to the next adjacent face at an angle that is preferably 90°, although angles that are larger or smaller than 90 degrees are acceptable. In any event, the corner angles, that is those joining the side surfaces, which join the opposite ends of each of the side surfaces to adjacent side surfaces are supplementary angles, that is, total 180 degrees.

The faces that make up the side surfaces of the stone are preferably planar, although irregular faces that will either interlock completely with faces of adjacent stones or which present voids when laid against a face of an adjacent stone, are acceptable. Such non planar faces can nonetheless be described as lying a plane for purposes of describing their general orientation.

Each of the side surfaces of the stone are formed of an odd numbered plurality of N faces, which may be said to include faces I, numbered consecutively from 1 to N, from one end of a side surface to the other. The faces are joined to adjacent faces within the side surface at alternating equal interior and exterior angles, to thereby form a step-shaped side surface with the odd numbered faces parallel to each other and the even numbered faces parallel to each other. As such, the end faces and the odd number internal faces, or central faces, will lie generally along parallel planes, for each side surface. The even numbered faces, or interconnecting faces, will lie generally along parallel planes that intersect those of the even numbered faces, will be one in number less than the odd numbered faces and one in number greater than the number of central, or internal even numbered, faces.

For the stones to interlock completely to be able to form a totally closed pattern in which the entire ground surface is covered, the side surfaces should be mirror images of each other, with the I-th face of each side being equal in length to the (N+1-I)-th face of the opposite side. (The term "length" of a face is used refer to the dimension of a face parallel to that of the top and bottom horizontal surfaces of the stone.) Preferably, the opposite sides are symmetrical about their centers, with the I-th and (N+1-I)-th faces of each side surface equal to each other. In this way, the stones can be laid in one of two directions to produce the same pattern. Preferably still, all of the sides will be identical, with the I-th and the (N+1-I)-th faces of all of the stones being equal. As such, the stones will be capable of being placed in any one of four orientations to produce the same pattern.

The faces of the side surfaces are preferably vertical, being perpendicular to the top and bottom surfaces of the stone. However, some deviation from the vertical could be employed.

In the more preferred embodiments of the invention, the faces of the sides, and preferably the odd numbered faces of the sides, are of at least two lengths to produce more desirable drainage areas when the stones are laid in open patterns. In the preferred and illustrated embodiment, the faces are of two lengths, with each side having two parallel end faces of a major length separated by three internal faces of a minor length, two of which are interconnecting faces perpendicular to and adjacent the major faces while the other of which is a control face that lies parallel to the major faces and lies in a plane spaced halfway between parallel plains that contain the two major end faces, to which the control face is joined by the two interconnecting faces.

The ratio of the lengths of the major to the minor faces may be any practical ratio, preferably within the range of from 1:1 to 20:1, although a ratio of 8:1 or less is preferable, with ratios of from 2:1 to 5:1 most preferred. The preferred ratio of major to minor faces of each of the side surfaces is about 3:1, which is the ratio illustrated in the drawings.

The stones of the preferred embodiment of the invention can be laid with each of the four sides of each stone adjacent a full side of another stone, leaving no additional drainage space, other than the standard joint width, between them. This is what is referred to herein as a "closed pattern". With the present invention, a stone of a single size and shape can completely cover the ground with a closed pattern.

The stones of the present invention can each be laid in a variety of open patterns, each with different combinations of faces of adjacent stones lying adjacent each other, in an offset fashion. The offset may be either in a transverse direction, in a longitudinal direction, or in both directions. Different combinations of faces of adjacent stones may lie adjacent each other in the longitudinal and transverse directions to produce an increased variety of patterns.

As a result of the present invention, paving stones of a single size and shape can be used to form a variety of interlocking patterns, either to fully cover the ground in a closed pattern, or to cover the ground in any one of a plurality of open patterns, each presenting a fixed percentage of drainage space. Each of the patterns interlocks to some degree, and the patterns that interlock the most are preferred. Each of the patterns produced presents a unique aesthetic appearance, and provides resistance to loads without damage. According to the invention, stones having the properties provided are capable of being manufactured from a single mold.

These and other objectives and advantages of the present invention will be more readily apparent from the following detailed description of the drawings in which:

DETAILED DESCRIPTION OF THE DRAWINGS

Figure 1:
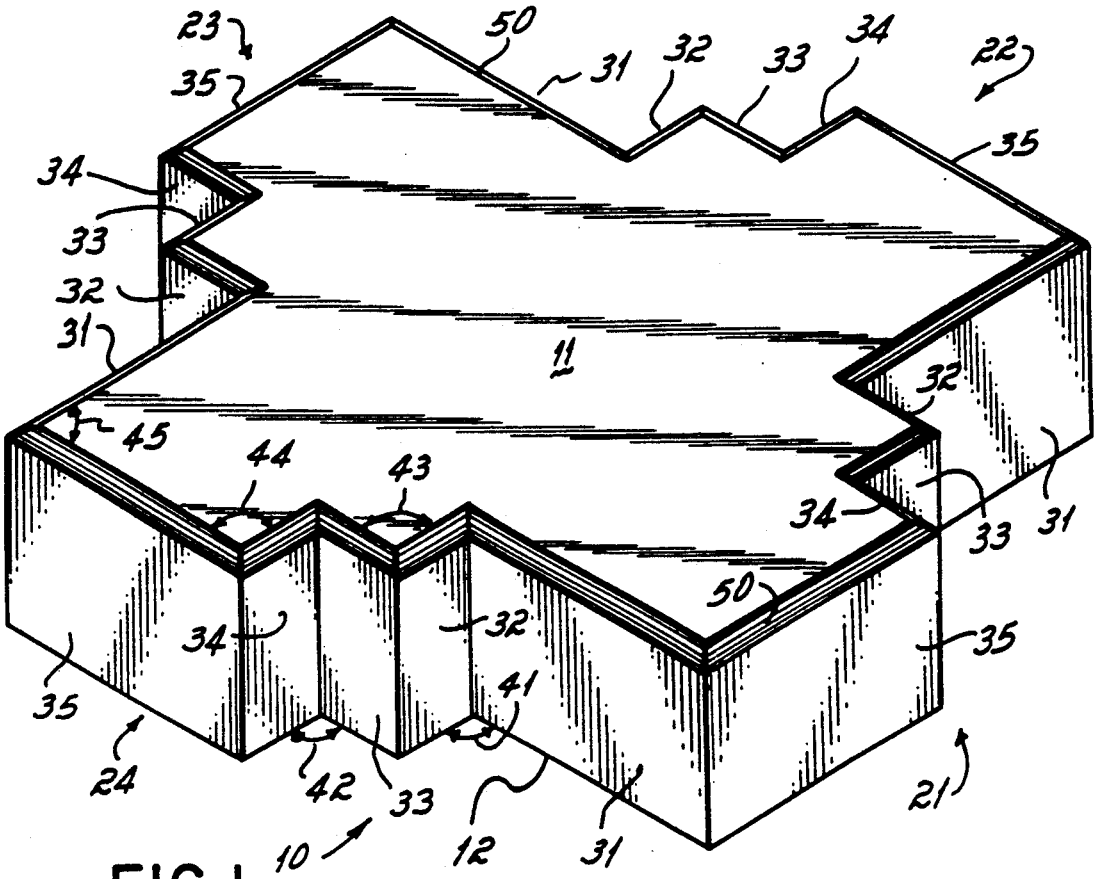
FIG. 1 is a perspective view of a paving stone for covering the ground and the like, according to one embodiment of the present invention.
Figure 2:
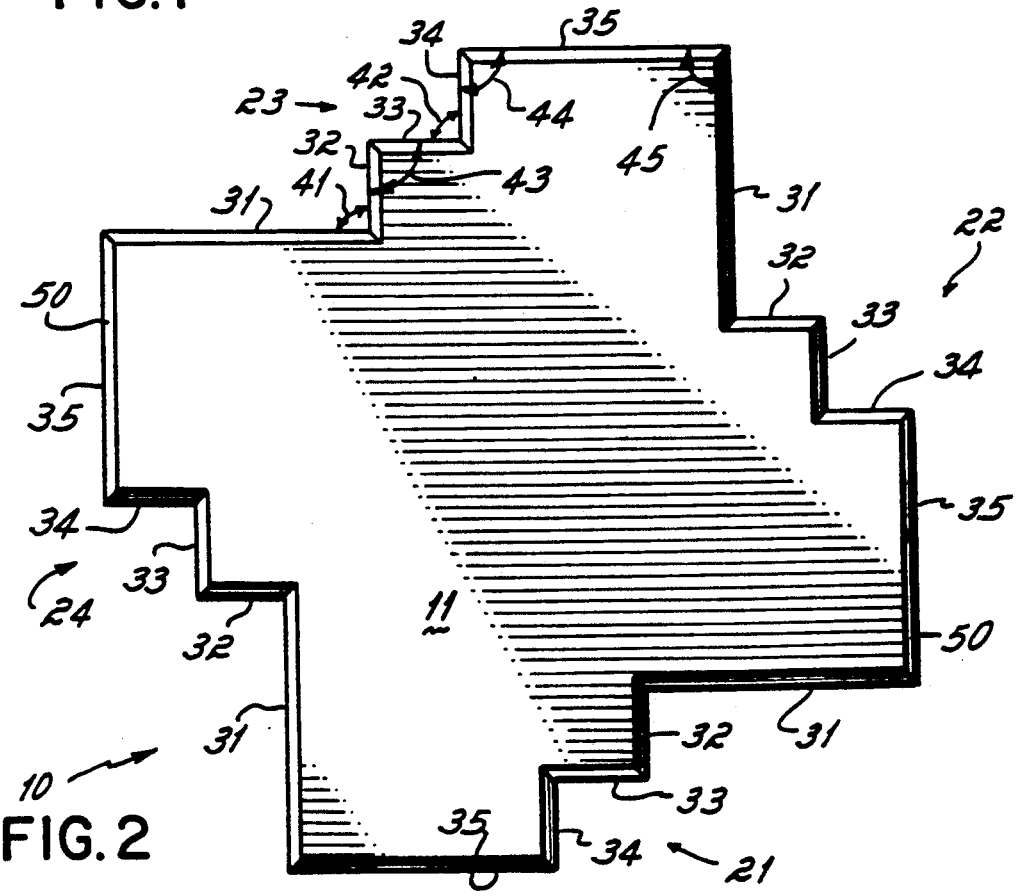
FIG. 2 is a top plan view of the paving stone of FIG. 1.

Referring to FIGS. 1 and 2, a paving stone 10 according to one preferred embodiment of the present invention is illustrated. The stone 10 has parallel planar top and bottom surfaces 11 and 12, respectively, that are polygonal in shape, each having four multi-faced sides which define upper and lower edges of respective side surfaces 21–24 of the stone 10. Each of the side surfaces 21–24 has five faces 31–35, two end ones of which, 31 and 35, are longer or major faces, and three interior ones of which, 32–34, are shorter or minor faces.

In this preferred and illustrated embodiment, the two major faces of each side surface, 31 and 35, are identical in length and parallel to each other. The major faces 31 and 35 of opposite side surfaces, 21 and 23, and of the opposite side surfaces 22 and 24, are also parallel to each other, with the major faces of side surfaces 21 and 23 being perpendicular to those of side surfaces 22 and 24.

The minor face 33 of each side is a central internal face parallel to the major faces 31 and 35 of the respective side surface, and lies between and is adjacent to the two minor interconnecting interior faces 32 and 34 of such side surface. The interconnecting faces 32 and 34 of this embodiment are perpendicular to the minor face 33 and thus also the major faces 31 and 35 of the corresponding side.

Angle 41 between the major face 31 and the minor face 32, and angle 42 between the minor face 34 and the major face 35, are internal right angles, in the preferred and illustrated embodiment, while all other angles, including angle 43 between the minor faces 32 and 33, angle 44 between the minor face 34 and major face 35, and corner angle 45 between major faces 35 and 31 of adjacent sides, are external right angles.

In the preferred and illustrated embodiment, the ratio of the lengths of the major faces to the lengths of the minor faces is 3:1, but any practical ratio is beneficial. The preferred limits of the practical range of ratios is from 1:1 to 20:1, however, ratios in the range of from 2:1 to 8:1 are preferred.

Each of the faces 31–35 of each of the side surfaces 21–24 may have a beveled edge 50 between the face 31–35 and the top surface 11 of the stone 10 to emphasize the overall shape of the stone 10 in the formation of patterns. Additionally, internal and false edges may be provided by V-grooves or similar features in the top surface 11 to provide an aesthetic effect in the pattern that is different from that provided by the shape of the stone 10 alone.

The paving stone 10 of FIGS. 1 and 2 is preferably generally square in dimension with all of the four side surfaces 21–24 being equal. It is not necessary, however, that all of the sides 21–24 be equal but only that the opposite sides 21 and 23, 22 and 24 be equal and mirror images of each other, though they are preferably also symmetrical about their centers and thus identical. Similarly, the major faces 31 and 35 are preferably of equal length for all side surfaces, and the minor faces 32–34 are preferably are of equal length for all side surfaces.

The overall dimensions of the stone should be such that a workman can handle stones in one hand without tiring. Preferably, the stones are approximately the size and weight of a standard brick or are slightly larger, preferably 7–10 inches in maximum dimension, and preferably 1/5 to 2/5 of the overall dimension in thickness, the thickness being the distance between the upper and lower faces 11 and 12.

Figure 3:
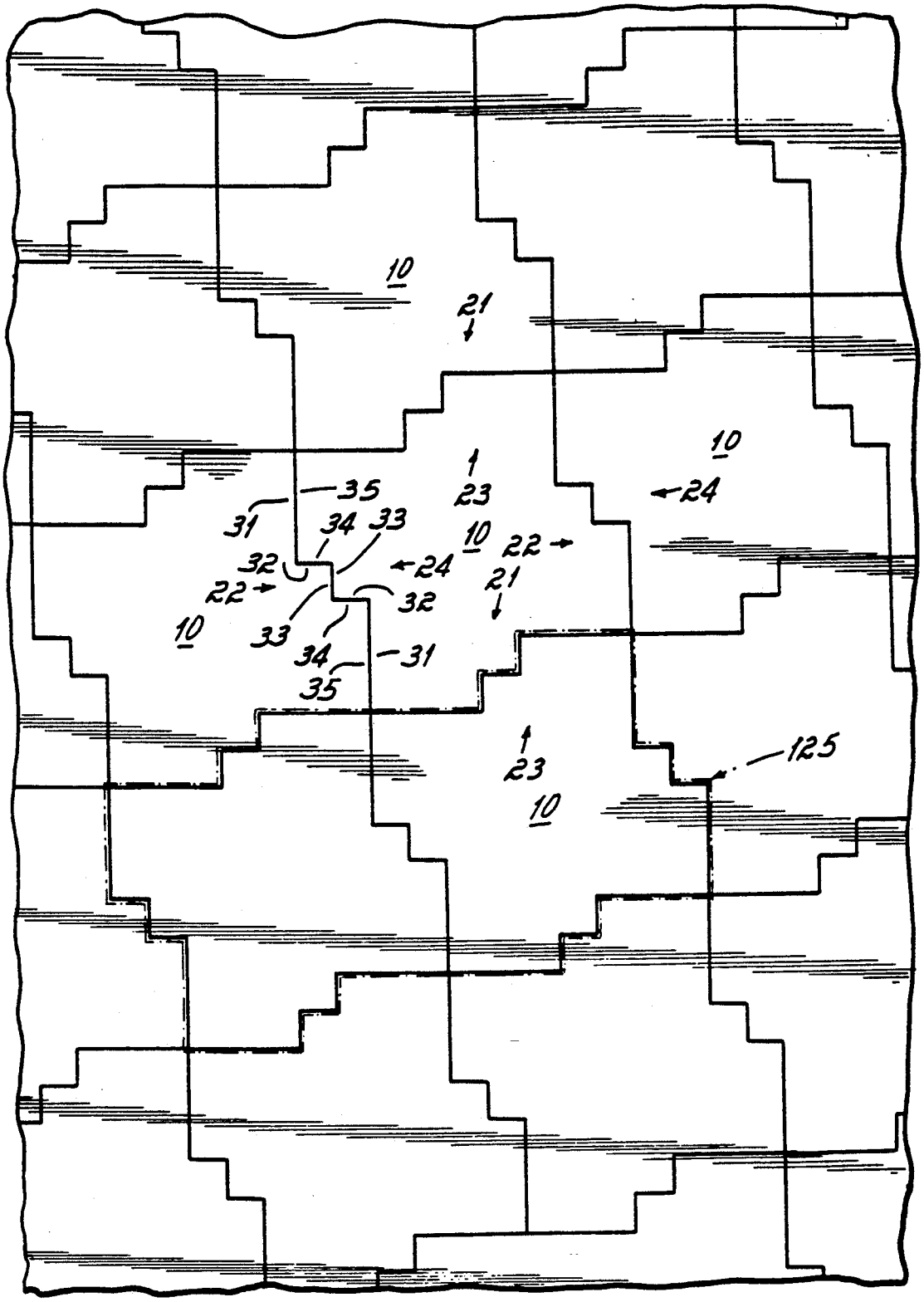
FIG. 3 is a plan view of a closed ground cover pattern using the paving stone of FIGS. 1–2.

Referring to FIG. 3, a plurality of paving stones 10 are illustrated arranged in a closed pattern. In the pattern of FIG. 3, the sides 21 and 23 of adjacent stones are adjacent and the sides 22 and 24 of adjacent stones are adjacent. So arranged, each of the sides has major faces 31 adjacent a major face 35 of an adjacent stone, minor faces 32 and 34 are adjacent the minor faces 34 and 32, respectively, of an adjacent stone, and minor face 33 adjacent a minor face 33 of the adjacent stone. The pattern of FIG. 3 provides minimal drainage, only to the extent of that presented in the nominal spacing between adjacent faces of the adjacent stones.

Figure 4:
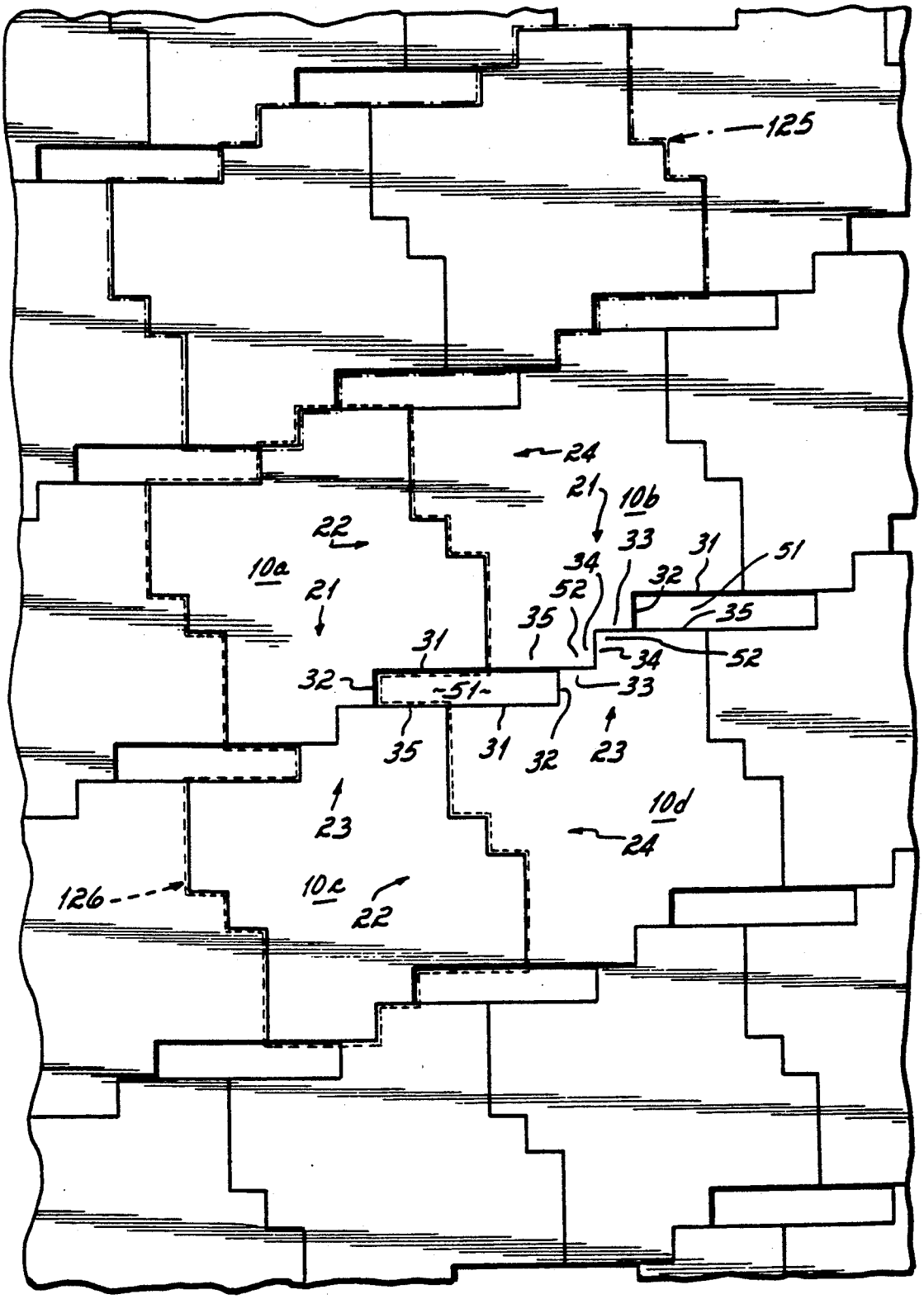
FIG. 4 is a plan view similar to FIG. 3 illustrating the same paving stone of FIGS. 1–2 laid in one of the variety of open, drainage facilitating patterns.

FIG. 4 illustrates the paving stones 10 laid in an open pattern which provides open areas 51 which constitute approximately 9½% of the area covered by stone 10, the area 51 is filled with loose aggregate such as sand for drainage. In the pattern of FIG. 4, the sides 21–24 of the stones **10*a*–10*d* are oriented as with the pattern of FIG. 3, except that, as seen with respect to stone 10*b*, for example, only a portion 52 of the face 35 of side 21 is adjacent face 33 of side 23 of adjacent stone 10*d*, while face 34 of side 21 of stone 10*b* is adjacent face 34 of side 23 of adjacent stone 10*d*. Further, face 32 of side 21 of, for example, stone 10*a*, and face 32 of side 23 of stone 10*d* are each bounding a small side of the rectangular space 51, with a portion of face 35 of side 21 of stone 10*b* and face 31 of side 21 of stone 10*a* bounding one long side of a space 51, with face 31 of side 23 of stone 10*d* and a portion of face 35 of side 23 of stone 10*c* bounding the opposite long side of space 51. Sides 22 and 24 of adjacent stones, in the pattern of FIG. 4, have their faces adjacent the same corresponding faces as with the pattern of FIG. 3**.

Figure 5:
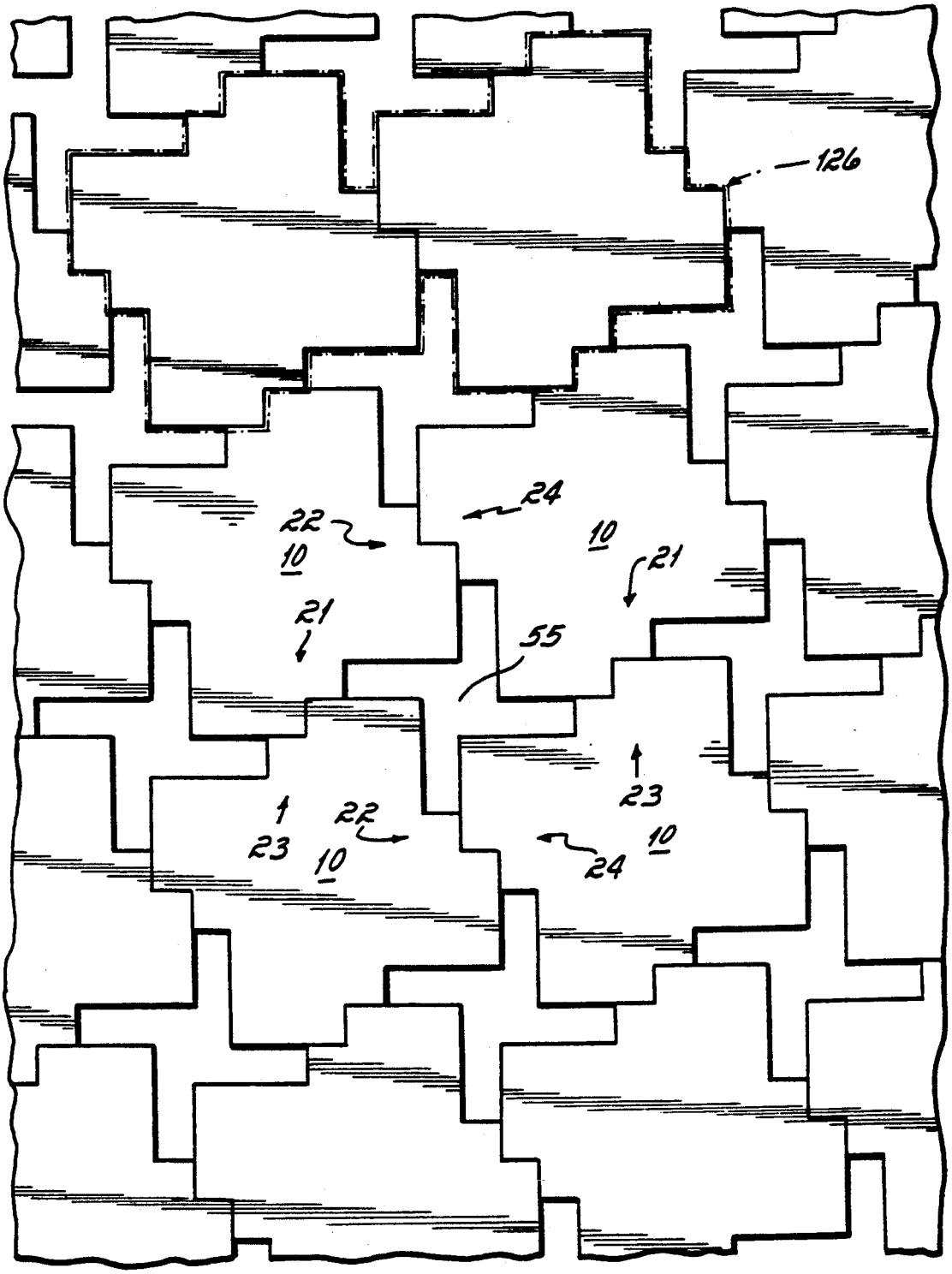
FIGS. 5–9 are each plan views similar to FIG. 4 illustrating the same paving stone of FIGS. 1–2 laid in different ones of the variety of open, drainage facilitating patterns provided by the invention, each of the patterns capable of presenting a different percentage of drainage area on the paved surface.

Referring to FIG. 5, another open pattern of the stones 10 is illustrated. In the pattern of FIG. 5, the stones 10 are offset in both the longitudinal and transverse directions such that the faces of adjacent stones, sides 21 and 23, as well as those on the sides of 22 and 24, abut each other as the sides 21 and 23 of the stones abut in FIG. 4. In the pattern of FIG. 5, a cross-shaped space 55 is formed which is filled with loose material such as sand, to present a drainage area of about 23% of the area covered by the stones 10.

Figure 6:
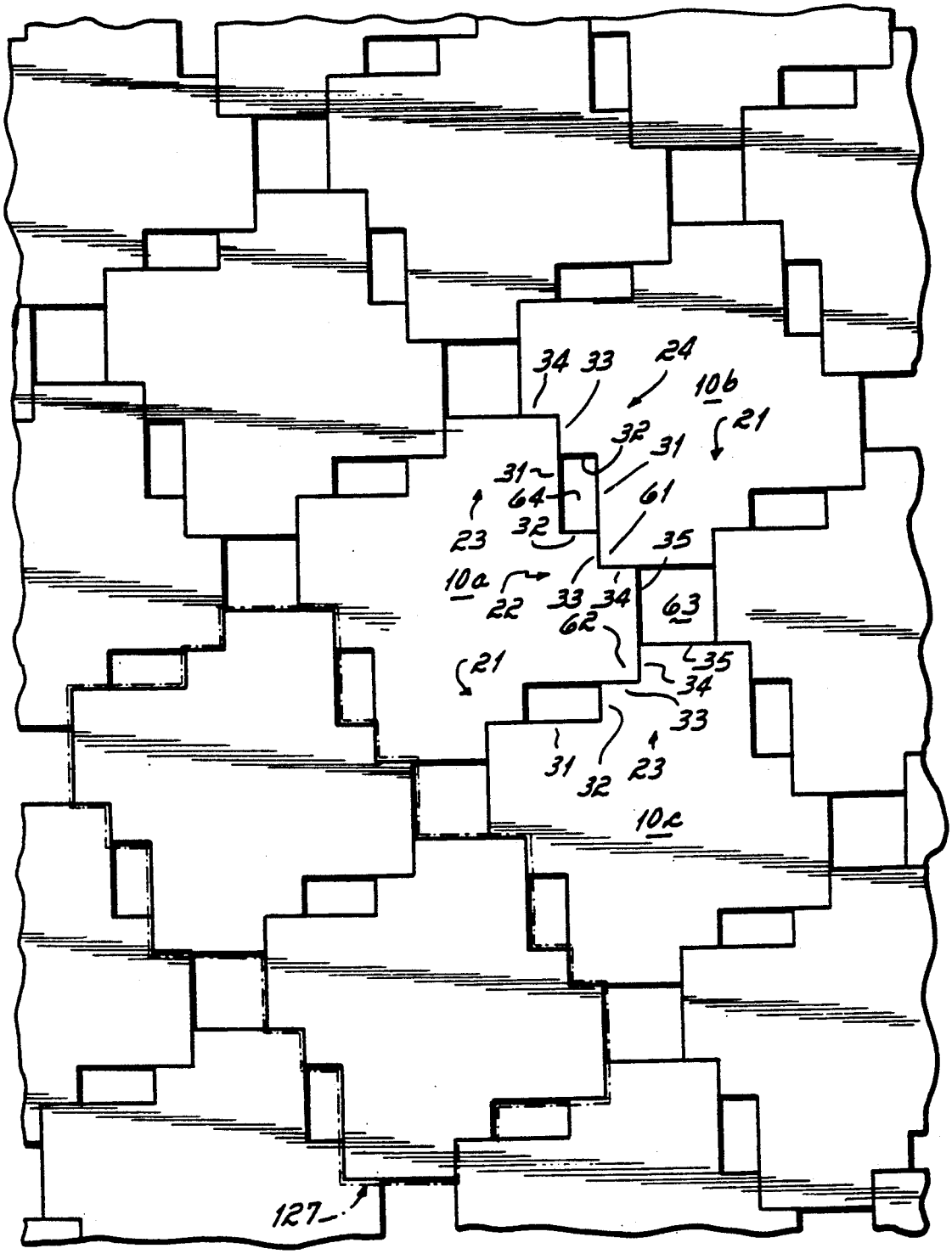

FIG. 6 illustrates another opened pattern formed by a plurality of the paving stones 10. In the pattern of FIG. 6, the face 33 of side 22 of stone **10*a* abuts a portion 61 of face 31 of side 24 of adjacent stone 10*b*, while a portion 62 of a face 35 of side 22 of stone 10*a* abuts face 34 of side 23 of adjacent stone 10*c*. The remainder of the face 35 of side 22 of stone 10*a* abuts a square drainage space 63 representing a drainage area of a little more than 7½% of the surface area covered by the stones 10, while the remainder of the faces 31 of sides 22 of stones 10*a* and 10*b*, as well as faces 32 thereof, bound a rectangular drainage space 64 which represent a little less than 4% of the area covered by the stones 10. The combined area of spaces 63 and 64 representing somewhat more than 11% of the area covered by the stones. In the pattern of FIG. 6**, the stones are offset in a similar fashion in both the longitudinal and transverse directions.

Figure 7:
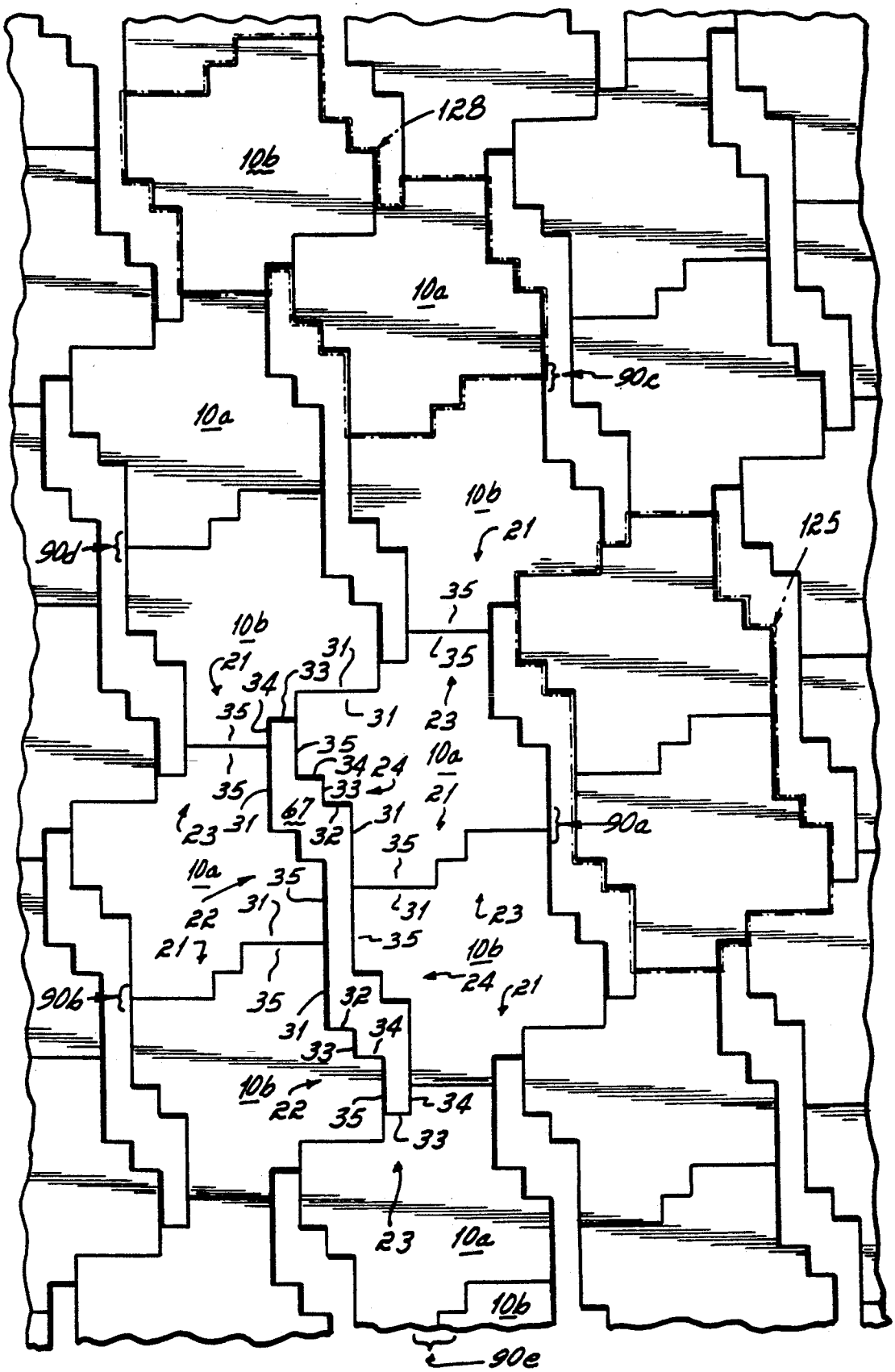

Referring to FIG. 7, an additional open pattern formed by the paving stones 10 is illustrated. In the pattern of FIG. 7, pairs of the stones 10 are arranged with sides 21 and 23 adjacent in the closed arrangement described in connection with FIG. 3. In FIG. 7, these pairs are, for example, pairs **90*a*–90*e*, each made up of a stone 10***a* and a stone 10*b*. The pairs of stones 10*a* and 10*b* are arranged, for example, with the face 35 of side 21 of stone 10*b* of pair 90*d* adjacent of face 35 of side 23 of stone 10*a* of pair 90*b*, and face 31 of side 21 of stone 10*b* of pair 90*d* adjacent face 31 of side 23 of stone 10*a* of a pair 90*a*. This arrangement is continued for the other pairs of stones 10*a* and 10*b*. The pattern that is formed leaves one elongated drainage area 67 for each pair of stones. The drainage areas 67 make up approximately 21% of the area covered by the stones in the pattern. Each drainage area 67 is bounded, for example, by faces 34 and 33 of side 21 of stone 10*b* of pair 90*d*, a portion of face 35, face 34, face 33, face 32 and face 31 of side 24 of stone 10*a* of pair 90*a*, all of the faces of side 24 of stone 10*b* of pair 90*a*, faces 34 and 33 of side 23 of stone 10*a* of pair 90*e*, a portion of face 35, face 34, face 33, face 32 and face 31 of side 22 stone 10*b* of pair 90*b*, and all of the faces of side 22 of side 22 of stone 10*a* of pair 90*b*.

Figure 8:
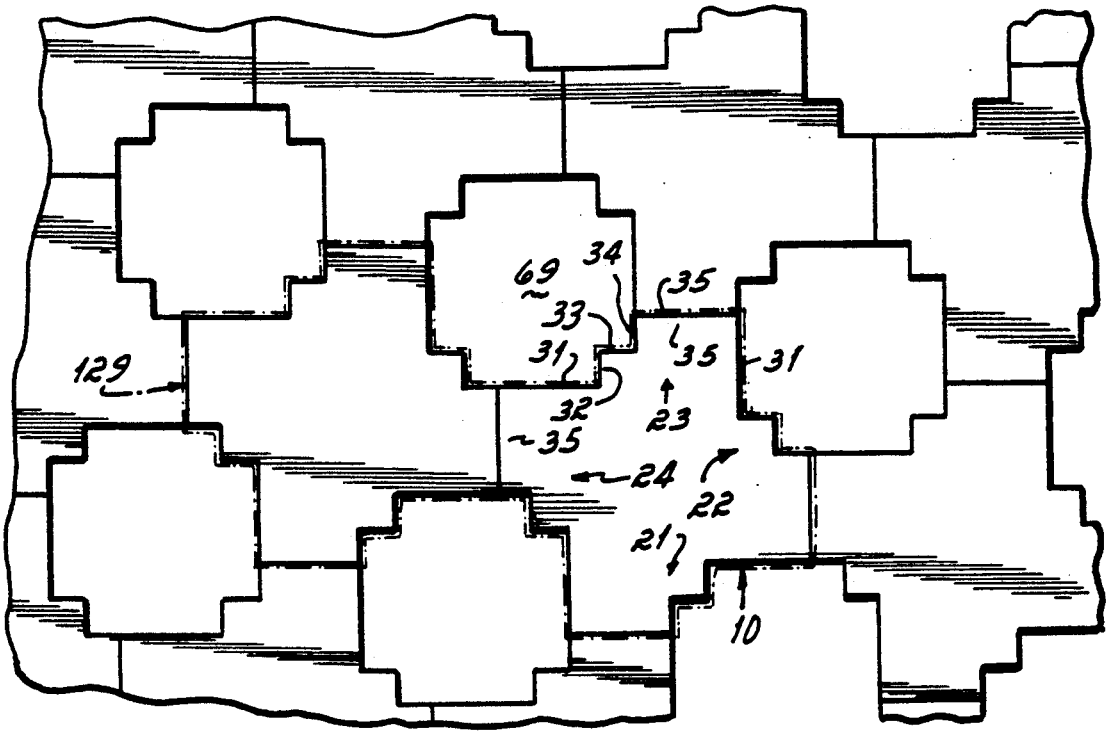

Referring to FIG. 8, a further open pattern formed by the stones 10 is illustrated. In the pattern of FIG. 8, the sides of the stone, both in the longitudinal and transverse directions, are arranged such that the faces 35 of adjacent sides of adjacent stones are adjacent. With this pattern, the faces 31, 32, 33, and 34 of each of the stones bound a drainage area 69 that is in excess of 60% of the area covered by the stones 10. The stones of this do not effectively interlock, in that no outside corner of one stone fits into an inside corner of another. Thus, this type of pattern is preferred only for limited load applications.

Figure 9:
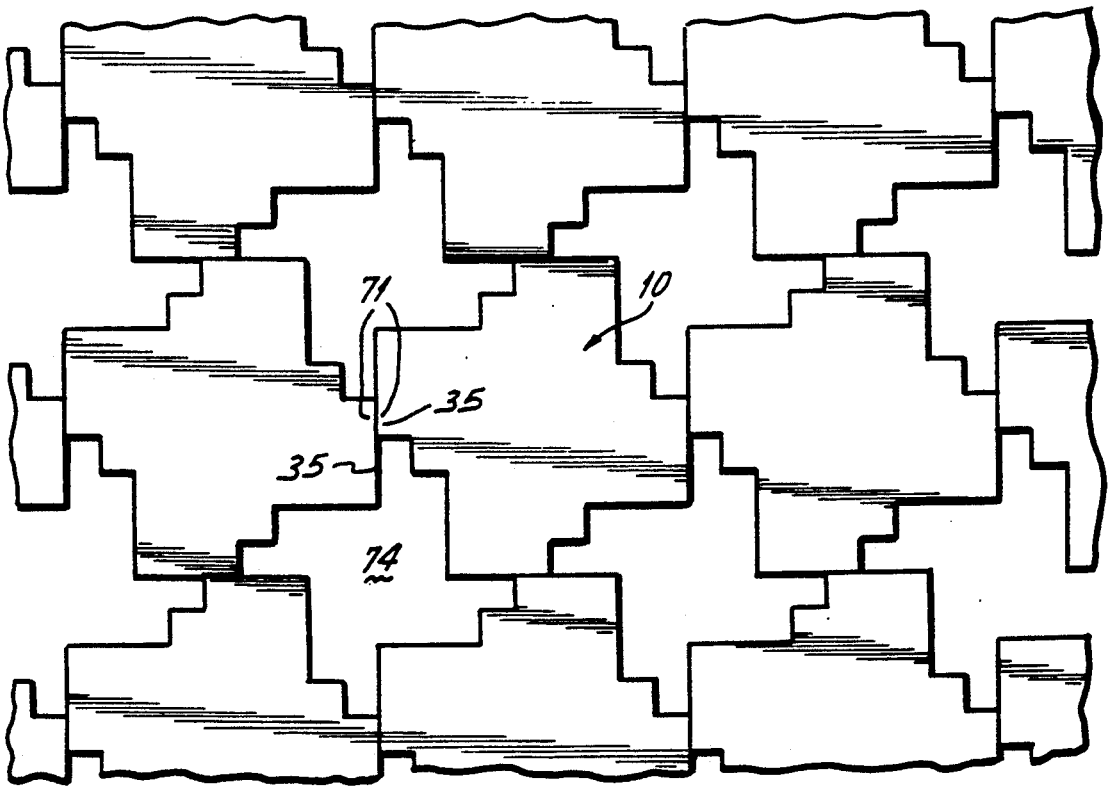

Referring to FIG. 9, a further open pattern formed by stones 10 is illustrated. In the pattern of FIG. 9, the stones 10 are arranged in a similar manner in both the longitudinal and transverse directions, with only a portion 71 of the faces 35 of adjacent sides of adjacent stones in contact. With the pattern of FIG. 9, the stones 10 do not effectively interlock, but can be arranged such that the portion 71 of the faces 35 that is in contact with an adjacent face 35 of an adjacent stone is any amount of the face 35 and will form a pattern with a drainage area 74 which is in excess of 50% of the area covered by the stones 10.

It is important that the sides of the stones 10 have at least one step therein with at least one interconnecting face separating two end faces of the side. While some patterns can be formed with stones having sides of a single step, it is much preferred that the sides or at least one set of opposite sides have a plurality of steps therein for better interlocking of the adjacent stones, more positive setting of the drainage spaces as with the patterns of FIGS. 4, 5 and 6, and greater variety in the number of different patterns with different drainage ratios that can be formed. A provision of more steps in the sides of the stones 10 will provide a greater number or different configurations of positive spacings of the drainage areas and a greater variety of easy to lay discreet interlocking patterns, each of which has a specifically ascertainable drainage area ratio.

Figure 10:
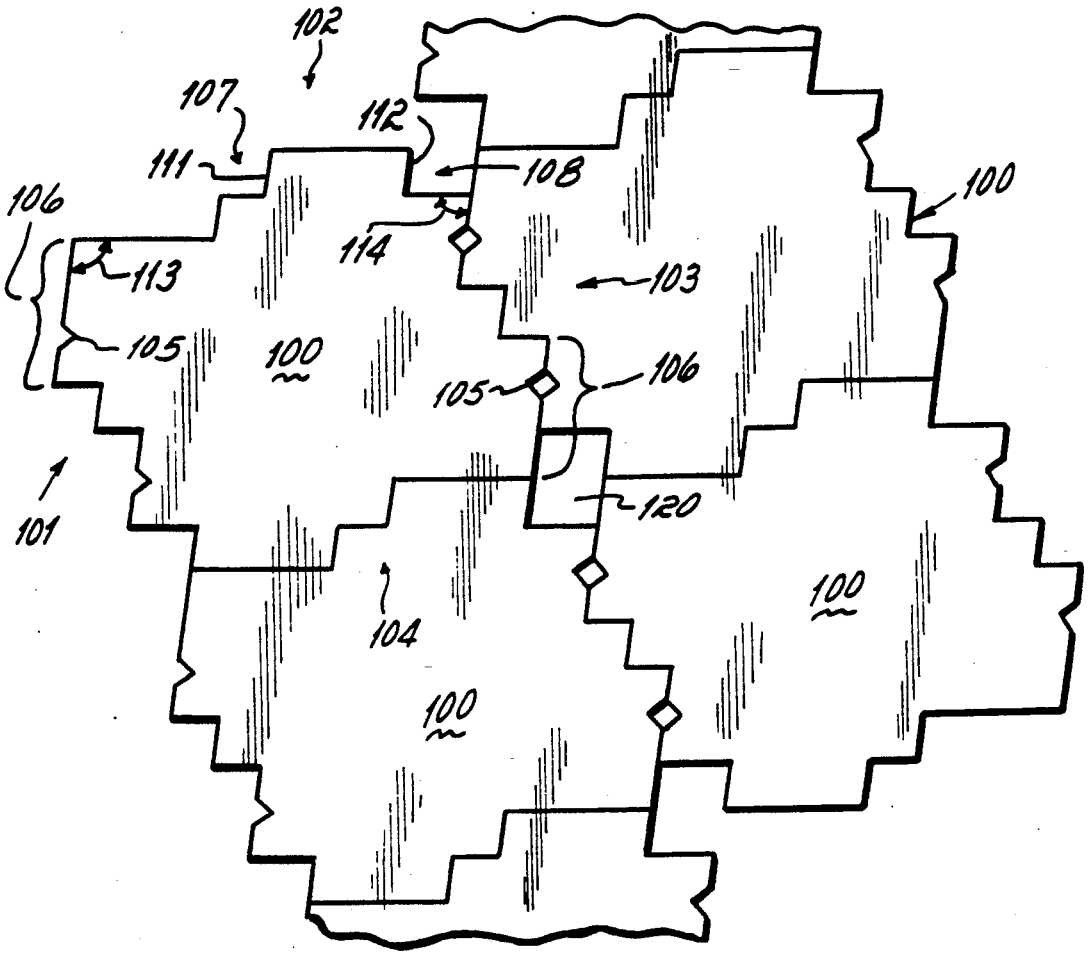
FIG. 10 is a plan view of an alternative embodiment of the present invention.

Principles of the present invention can be applied in alternative embodiments to those described above, as for example, with the stone 100 of FIG. 10. As shown in FIG. 10, a stone 100 is provide having a pair of opposite and identical lateral side surfaces 101 and 103, and a pair of opposite and identical longitudinal surfaces 102 and 104. The faces of the side surfaces 101 and 103 are similar to those of the figures described above, are placed, in the pattern shown, adjacent side surfaces of adjacent stones in a manner similar to that of FIG. 3. In this embodiment, some of the faces on the sides 101 and 103 are not planar, as represented by the notches 105 in the faces 106, although the faces, including the notch, lie generally in a plane. The notches 105 may cooperate with notches in adjacent faces, or an adjacent planar surface, to produce an additional drainage space. In addition, the side surfaces 102 and 104 have both outward and inward steps, that is, do not have the interior and exterior angles alternating across the width of the side surface, producing upward and downward steps at 107 and 108, for example. In this embodiment, the angles are not right angles, but those on the lateral side surfaces 101 and 103 are acute angles. On the longitudinal side surfaces 102 and 104, where the steps formed are not all in the same direction, the angles joining the interconnecting faces, as for example faces 111 and 112, are equal to the corner angle that those interconnecting faces generally face. For example, the angles joining the face 111 equal the corner angle 113, while those joining the face 112 equal the corner angle 114. The obtuse angles so formed are supplementary to the acute angles. In the pattern shown in FIG. 10, drainage spaces 120 are formed. Other arrangements of the stone 100 will yield drainage spaces of different shapes and sizes.

It can be further seen that stones may be formed, in accordance with certain principles of the present invention, by combining two stones into stones of one piece, as, for example, by joining two stones 10 into one stone 125 in FIGS. 3, 4, and 7, or by joining stones 10*a* and 10*c* in FIG. 4 or two stones 10 in FIG. 5 to form a stone 126, or by joining two stones to form stone 127 (with or without the drainage space 64*a*) in FIG. 6, or by joining two stones, 10*b* and 10*a* of different pairs 90 to form the stone 128, by joining two stones 10 to form the stone 129 in FIG. 8, or by joining other combinations of two or more stones 10 (FIGS. 1–9), stones 100 (FIG. 10), or other stones according to the invention.

While the preferred embodiments of the invention are described in detail above, it will be apparent to those skilled in the art that modifications and variations of the paving stone may be made without departing from the principles of the present invention.

Accordingly, what is claimed is:

1. An interlocking paving stone capable of being laid in either a closed pattern or a plurality of open patterns, comprising:

an integral block of molded ceramic material having a generally horizontal upper surface, a lower surface generally identical and generally parallel to the upper surface and spaced from the upper surface a distance defining the thickness of the stone, and four generally identical multifaced side surfaces;

each of the side surfaces being generally perpendicular to the upper and lower surfaces and having first and second major end faces respectively lying in spaced parallel first and second vertical planes, each first major end face being joined to a second major end face of an adjacent side surface at an exterior and approximately right angle, and each second major end face being joined to a first major end face of another and oppositely facing adjacent side surface at an exterior and approximately right angle;

each of the side surfaces having one central minor face lying in an intermediate vertical plane which is generally parallel to, lies between and is equidistant from the first and second planes;

each of the side surfaces having a first minor face, generally perpendicular to the planes and extending between the first and intermediate planes, which forms an interior and approximately right angle with the first major end face and an exterior and approximately right angle with the central minor face;

each of the side surfaces having a second minor face, perpendicular to the planes and extending between the second and intermediate planes, which forms an exterior and approximately right angle with the second major end face and an interior and approximately right angle with the central minor face; and the first and second major end faces being approximately equal in length and the first and second minor faces being approximately equal in length, with major faces having a total length greater than that of the minor faces.

2. The paving stone of claim 1 wherein:

the central minor face is approximately equal in length to the first and second minor faces;

the length of each of the major faces is between two and four times the length of each of the minor faces; and the thickness of the stone is between one fifth and two fifths the total length of a side surface thereof.

3. The paving stone of claim 2 wherein:

the length of each of the major faces is approximately three times the length of each of the minor faces.

4. The paving stone of claim 1 wherein:

the central minor face is approximately equal in length to the first and second minor faces.

5. The paving stone of claim 4 wherein:

the length of each of the major faces is between two and four times the length of each of the minor faces.

6. The paving stone of claim 1 wherein:

the thickness of the stone is greater than the length of the shortest face and less than the length of the longest face.

7. The paving stone of claim 1 wherein:

the length of each of the major faces is between less than twenty times the length of each of the first and second minor faces.

8. An interlocking paving stone capable of being laid in a plurality of open patterns, comprising:

an integral block of molded ceramic material having a generally horizontal upper surface, a lower surface generally identical and generally parallel the upper surface and spaced from the upper surface a distance defining the thickness of the stone, and four multifaced side surfaces;

each of the side surfaces having an odd plurality of faces joined at interior and exterior angles;

each of the faces of each of the side surfaces including a first end face lying generally in a first generally vertical plane and a second end face lying generally in a second generally vertical plane spaced from and generally parallel to the first generally vertical plane;

the first end face of each side surface being joined at one end thereof to the second end face of a first adjacent side surface at a first exterior corner angle, and the second end face of each side surface being joined at one end thereof to a first end face of a second and opposite adjacent side surface at a second exterior corner angle that is supplementary to the first corner angle;

each of the side surfaces having an odd plurality of interior faces including:

at least one central face lying generally in an intermediate generally vertical plane that is generally parallel to and lies between the first and second planes, and a plurality of generally parallel interconnecting faces, the number of interconnecting faces being equal to one more than the number of central faces, each interconnecting face extending between a different pair of the planes, and each interconnecting face forming an interior or exterior angle equal with the planes equal to one of the corner angles.

9. The paving stone of claim 8 wherein:

the end faces of each side surface are equal in length.

10. The paving stone of claim 8 wherein:

the angles are right angles.

11. The paving stone of claim 8 wherein:

the interconnecting faces of each side surface are equal in length.

12. The paving stone of claim 8 wherein:

opposite side surfaces are identical.

13. The paving stone of claim 12 wherein:

all of the side surfaces are identical.

14. The paving stone of claim 8 wherein:

all of the faces are planar.

15. The paving stone of claim 8 wherein:

each of the interconnecting faces, being generally oriented in a direction toward one of the corner angles, forms angles with the adjacent faces that are approximately equal to the corner angle toward which the respective interconnecting face is oriented.

16. The paving stone of claim 8 wherein:

the angles joining the faces of each of the side surfaces are alternating interior and exterior angles; and each of the interconnecting faces forms, with an adjacent face, an interior angle, equal to the first corner angle, at the end of the interconnecting face that is closest to the first plane, and an exterior angle, equal to the first corner angle, at the end of the interconnecting face that is closest to the second plane.

17. An interlocking paving stone capable of being laid in a closed pattern and a plurality of different open patterns, comprising:

an integral block of molded ceramic material having a generally horizontal upper surface, a generally identical and generally parallel lower surface spaced from the upper surface a distance defining the thickness of the stone, and four multifaced side surfaces each generally perpendicular to the upper and lower surfaces;

each of the side surfaces having an odd plurality of faces I, N in number, including 1-st through N-th faces, joined in sequence to form alternating interior and exterior angles, where I is a number from 1 to N corresponding to the respective faces of each side in sequence proceeding clockwise from an end of the side surface;

the 1-st face of each side surface being joined at one end thereof to the N-th face of a first adjacent side surface at a first exterior corner angle, and the N-th face of each side surface being joined at one end thereof to a 1-st face of a second and opposite adjacent side surface at a second exterior corner angle;

each of the faces I, where I is even, being joined at one interior angle and one exterior angle to the faces adjacent thereto;

each of the faces I, where I is odd, of each side surface and of the side surface opposite thereto being generally parallel to each other;

the faces I, where I is even, of each side surface being generally parallel to each other and to the faces I, where I is odd, of the adjacent side surfaces; and the I-th face of each side surface having a length equal to the length of the (N+1-I)-th face of the opposite side surface.

18. The paving stone of claim 17 wherein:

the I-th and (N+1-I)-th faces of each side surface are equal.

19. The paving stone of claim 17 wherein:

the length of each of at least one of the faces I, where I is odd, of at least one of the side surfaces is at least twice the length of another face of that side surface.

20. The paving stone of claim 17 wherein:

the four side surfaces are identical.

* * * * *